United States Patent [19]

Mattei et al.

[11] Patent Number: 4,592,470

[45] Date of Patent: Jun. 3, 1986

[54] DEVICE FOR INFEEDING CIGARETTES TO THE WRAPPING LINE OF A PACKER

[75] Inventors: Riccardo Mattei; Gastone Dall'Osso, both of Bologna, Italy

[73] Assignee: G. D. Società per Azioni, Bologna, Italy

[21] Appl. No.: 667,734

[22] Filed: Nov. 2, 1984

[30] Foreign Application Priority Data

Dec. 7, 1983 [IT] Italy ..... 3650 A/83

[51] Int. Cl.[4] ..... B07C 5/344; A24C 5/32

[52] U.S. Cl. ..... 209/535; 53/54; 131/907; 209/629; 209/643; 209/688

[58] Field of Search ..... 209/535–539, 209/629, 643, 644, 688; 131/282, 283, 907, 908; 53/54, 148, 151, 498, 500; 221/134, 216, 224

[56] References Cited

U.S. PATENT DOCUMENTS

| | | | |
|---|---|---|---|
| 3,721,340 | 3/1973 | Kruse et al. | 209/643 X |
| 3,730,342 | 5/1973 | Egan et al. | 209/643 |
| 4,093,075 | 6/1978 | Molins | 209/535 |
| 4,376,484 | 3/1983 | Sergnoli | 209/535 |
| 4,445,520 | 5/1984 | Knight et al. | 131/907 X |

FOREIGN PATENT DOCUMENTS

| | | | |
|---|---|---|---|
| 1134468 | 7/1955 | France | 209/688 |
| 1050432 | 12/1966 | United Kingdom . | |
| 1298785 | 12/1972 | United Kingdom . | |
| 1569470 | 6/1980 | United Kingdom . | |
| 2023994 | 10/1982 | United Kingdom . | |

*Primary Examiner*—Robert B. Reeves
*Assistant Examiner*—Edward M. Wacyra
*Attorney, Agent, or Firm*—Cushman, Darby & Cushman

[57] ABSTRACT

Disclosed herein is a device for infeeding cigarettes to the wrapping line of a packer, provided with: a hopper, the lower part of which contains the cigarettes in the form of stacks that are movable in steps along corresponding channels outgoing from the hopper; a sensor for checking, in succession, the cigarettes in the channels with each step forward of the stacks; and at least one cigarette expelling device, interlocked to the sensor, placed along the channels downstream of the sensor, in the direction in which the stacks move forward. Provision is also made for a device with which to engage and restrain the faulty cigarettes, able to brake the cigarettes during expulsion and to complete the extraction thereof from the hopper.

7 Claims, 3 Drawing Figures

DEVICE FOR INFEEDING CIGARETTES TO THE WRAPPING LINE OF A PACKER

BACKGROUND OF THE INVENTION

The invention relates to a device for infeeding cigarettes to the wrapping line of a packer.

DESCRIPTION OF THE PRIOR ART

The known practice is for the cigarettes to enter the packer via a hopper that feeds them to containers provided for the purpose or to a belt conveyor by which the cigarettes are carried in the form of a continuous layer. When leaving the hopper, the cigarettes are grouped in batches, each of which is made up of a number of cigarettes identical to that in one finished packet.

A check is made on the characteristics of the cigarettes in each batch and the batches in which there is even one single faulty cigarette are rejected.

In order to reduce the number of batches of cigarettes ejected and, thereby, to obtain a considerable financial saving, the same Applicant as herein, Messrs. G. D. S.p.A., proposed in U.S. Pat. No. 4,376,484, a device able to verify the soundness of the cigarettes while still in the hopper, and to effect any rejection thereof prior to the cigarettes reaching the batching station. Ejection from the hopper of the cigarettes is, in the said device, preferably effected by means of pneumatic expelling means that direct axially a blast of compressed air against cigarettes found to be faulty, causing the issuing thereof through apertures provided for the purpose in the said hopper.

A device of this type is not, however, devoid of problems since it has been seen that the faulty cigarettes frequently cause, during the expulsion thereof from the hopper, a disarrangement of the cigarettes above and below them. The cigarettes overhead of those that are faulty, in fact, often give rise to blockages sufficient to necessitate the packer to be halted since, following the sudden expulsion of the cigarettes immediately underneath, they undergo a brusque uncontrolled drop during which an incorrect arrangement thereof is frequently adopted. Also the cigarettes underneath those rejected tend to place themselves wrongly, during the expulsion of the faulty cigarettes, on account of the creation of vortices of air that suck them upwards in a disorderly fashion.

Then again, it happens frequently that a faulty cigarette sucks through the said apertures in the said hopper, a cigarette adjacent thereto, at the time of the described expulsion phase.

SUMMARY OF THE INVENTION

The object of the invention is, therefore, to make available a device of the above mentioned type, in which the foregoing problems do not occur.

The said object is attained by the device according to the invention for infeeding cigarettes to the wrapping line of a packer, comprising a hopper for supplying the cigarettes to the said machine, the lower part of the said hopper being subdivided into outgoing channels of an amplitude virtually identical to the diameter of one cigarette, through which the cigarettes, placed in stacks, descend in steps; sensor means provided, from the top down towards the bottom, along each of the said channels, for checking the cigarettes in succession; at least one ejector device interlocked to the said sensor means for the expulsion from the said hopper of the faulty cigarettes; and a contrivance for the interception and rejection of the said faulty cigarettes, placed, with respect to the said hopper, on the opposite side to that of the said expulsion means, and provided, for each of the said channels, with means for engaging with and restraining the said faulty cigarettes during the expulsion thereof from the said hopper, movable parallel to the axis of the said cigarettes between two extreme positions, one spaced away from the said hopper at a distance less than the length of the said cigarettes, and the other, at a distance greater.

BRIEF DESCRIPTION OF THE DRAWINGS

Two preferred embodiments for the device according to the invention will now be described with reference to the accompanying drawings, in which.

DESCRIPTION OF THE PREFERRED EMBODIMENTS

Figure 1:
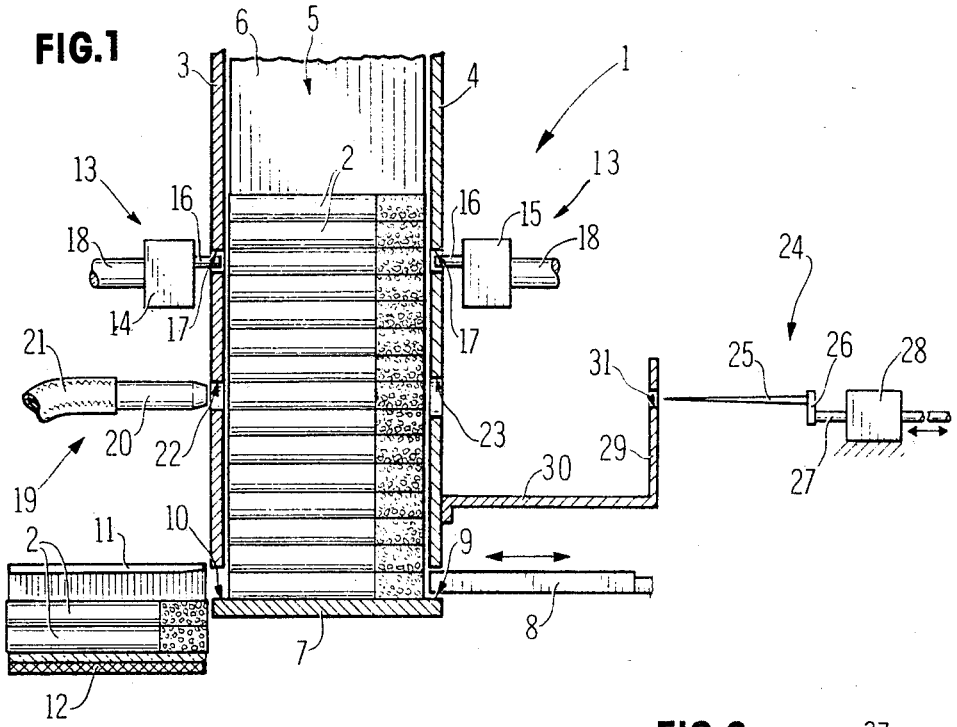
FIGS. 1 and 2 show, diagrammatically in two different operational phases, a first embodiment for an infeed device constructed in accordance with the terms of the invention.
Figure 2:
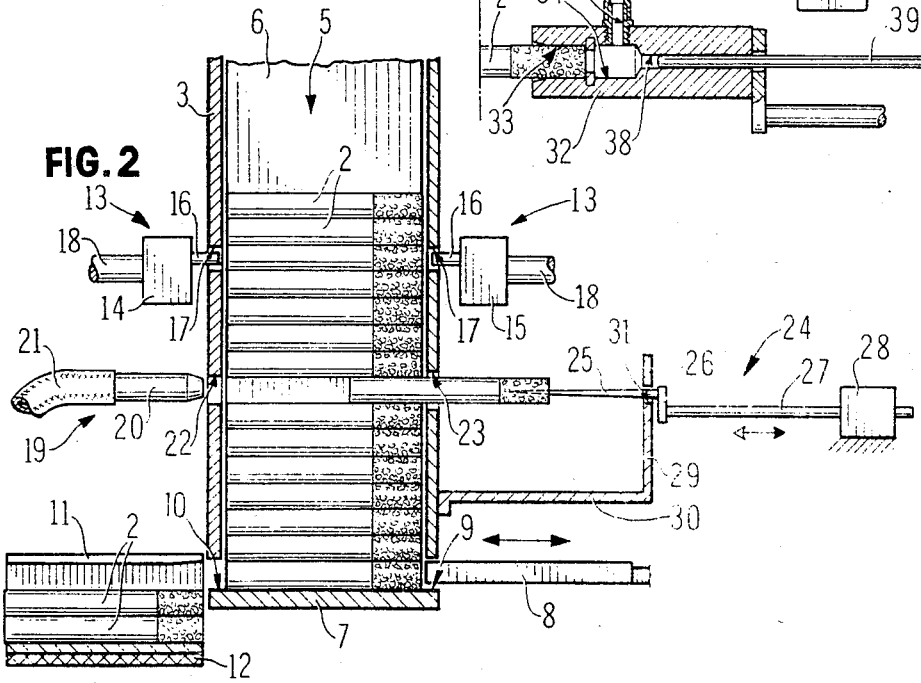

Illustrated in FIGS. 1 and 2 is an intake hopper 1, of a type in itself known, for supplying cigarettes 2 to a non-illustrated cigarette packer.

The hopper 1 is defined (looking at FIGS. 1 and 2) by a lefthand wall 3 and a rightand wall 4, vertical and one parallel with the other, that form a compartment of a width slightly over approximately the length of one cigarette 2. The said compartment is subdivided into a plurality of elementary channels 5 (one only of which is illustrated) by walls 6 (one only of which is shown in FIGS. 1 and 2), placed at a distance one from the other that is approximate to but slightly greater than the diameter of the cigarettes 2.

At the bottom, the elementary channels 5 are delimited by a horizontal wall 7 for supporting the columns of cigarettes 2 contained in the channels 5. The said cigarettes 2 are engaged in batches by a pusher member 8 movable in a horizontal direction, with reciprocating motion, perpendicularly to the walls 3 and 4 through horizontal slits 9 and 10 made in the walls 3 and 4 in a position adjacent to the wall 7 and of a height at least equal to the diameter of the cigarettes 2.

The pusher member 8 is movable from a non-active position, outside the hopper 1 and illustrated in FIGS. 1 and 2, to an operative position inside the hopper 1 for pushing the cigarettes 2 from the channels 5 into the inside of containers 11 (one only of which is illustrated) carried by a belt conveyor 12, provided with intermittent motion, for transferring the batches of cigarettes 2 towards a non-illustrated packer. In the course of the said transfer, non-illustrated expulsion means eject from the belt conveyor 12, any batches of cigarettes that contain one or more faulty cigarettes.

To understand better the structure of the hopper 1, the channels 5 and the pusher member 8, as well as that of the belt conveyor 12 and of the non-illustrated expulsion means, reference should be made to the description and the drawings of U.K. Pat. Nos. 1,298,785 and 2,023,994 in the name of the same Applicant as herein, Messrs. G.d S.p.A.

Provided along each channel 5 are sensor means or a device for checking the soundness of the individual cigarettes 2, shown globally at 13 and comprising two sensors or feelers 14 and 15, on opposite sides, for checking the two extremities of the individual cigarettes 2, each of which provided with a feeler pin 16 aligned with and on the opposite side to the corresponding pin 16 of the other sensor. The said pins extend through corresponding horizontal holes 17 made in the walls 3 and 4. The pins 16 are mounted in an elastic fashion on the sensors 14 and 15, respectively, and move with reciprocating motion across the holes 17 under the thrust of the pusher members 18 that operate alternately in opposite directions, in a synchronous manner.

Beneath the checking device 13, outside the hopper 1 and in front of the wall 3 is provided, in what is called the expulsion position, spaced with respect to the position of the pins 16 at a distance equal to or a multiple of the diameter of one cigarette 2, an expelling device 19 constituted by a nozzle 20, connected via a pipe 21 to a source of compressed air that is not depicted on the drawings. The said nozzle 20 is able to direct, via a hole 22 in the wall 3, a substantially horizontal blast of air inside the channel 5. Made in the wall 4 of the hopper 1, in alignment with the hole 22, there is a hole or aperture 23 for the outflow of the cigarettes 2 rejected.

The checking device 13 terminates at a contact (not illustrated) normally in an open condition, which closes in the case of detection on the part of the feeler pins 16 of a cigarette 2 that is too short or not sufficiently filled with tobacco at the extremities thereof. The said contact is able to set in operation, through a non illustrated memory element, the expelling device 19 for the ejection of the faulty cigarettes 2 at the time these are in alignment with the holes 22 and 23.

For a better understanding of the operation of the checking device 13 and of the expelling device 19, reference should be made to the description of the prior mentioned U.S. Pat. No. 4,376,484.

At the same level as the said expelling device 19 is situated a contrivance for the interception and rejection of the faulty cigarettes 2, shown at 24 and facing the wall 4 of the hopper 1 in proximity of the holes 23.

The said contrivance 24 comprises means for engaging with and restraining the faulty cigarettes 2 including a plurality of pointed elements constituted by needles 25, turned towards the holes 23 and in axial alignment with the nozzle 20. The said needles 25 are supported by one common sustaining element constituted by a bar 26 horizontal and parallel to the wall 4.

The bar 26 is integral with a shaft 27 parallel to the cigarettes 2, provided with axial reciprocating motion whose time relationship with respect to the displacements of the pusher member 8 is determined by actuating means 28 supported in a way that is not shown on the drawings.

In between the bar 26 and the wall 4 are placed means for disengaging the faulty cigarettes 2 from the needles 25, comprising a wall 29 supported by a bracket 30 connected to the hopper 1, parallel to the said wall 4 and spaced away there from at a distance greater than the length of one cigarette 2. The wall 29 is provided with a plurality of holes 31 for the passage of the needles 25, the diameter of which is less than that of one cigarette 2.

In use, at the halting phase of each machine cycle and, therefore, in the halting condition of the stacks of cigarettes 2 inside the channels 5, each one of the pins 16 probes, through a hole 17, a corresponding cigarette 2.

The needles 25, under the control of the actuating means 28, move with reciprocating motion at the same frequency as the pins 16, between two extreme positions, in the first of which (see FIG. 1) they are spaced away from the wall 4 at a distance greater in length than the length of one cigarette 2, and in the second of which (see FIG. 3) they are placed, in synchronism with the halting phases of the said stacks, a distance away from the holes 23 less than the length of the cigarettes 2.

Whenever a faulty cigarette 2 is detected, the checking device 13 takes steps, through the said memory element, to prepare the rejection thereof.

In consequence of this, the nozzle 20 of the channel 5 concerned sends forth, when the faulty cigarette 2 passes in the region of the holes 22 and 23, a blast of air that tends to expel the said cigarette from the hopper 1.

Prior to the complete discharge thereof through the hole 23, the cigarette 2 is intercepted and bracked by the corresponding needle 25 which, at that moment, occupies the position in which it is closest to the wall 4.

The said needle 25, inserted deeply in the filter of the cigarette 2, then moves away from the wall 4, completing the extraction from the hopper 1 of the said cigarette 2.

In proximity of the said second extreme position of the needles 25, and the end of the cigarette 2 is intercepted by the wall 29 and this causes the said cigarette to be withdrawn from the needle 25 and to drop down towards non illustrated means of collection.

Figure 3:
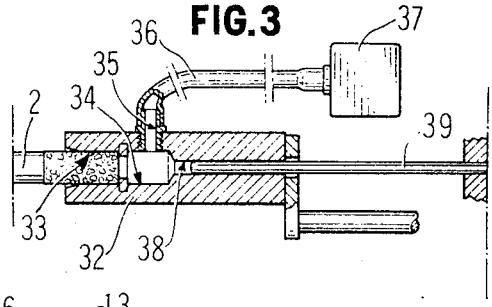
FIG. 3 shows, in a second embodiment, one detail in FIGS. 1 and 2.

The means for engaging with and restraining the cigarettes 2 are constituted, in the embodiment depicted in FIG. 3, by means of pneumatic type instead of by the needles 25.

Mounted for each channel 5 and coaxially to each hole 23 are, on the bar 26, cylindrical elements 32 that have turned towards the hopper 1, and extremity provided with a virtually cylindrical cavity 33 for housing the cigarette 2 ejected by the expelling device 19.

The back extremity of the cavity 33 communicates, via a cylindrical chamber 34 made in the element 32, in a radial hole 35 and in a flexible tube 36, with a source of suction 37.

Each cylindrical element 32 has passing through it, a hole 38 coaxial thereto and communicating with the chamber 34, inside which is inserted in a way whereby able to slide, a fixed shaft 39 whose task is that of the previously described means of disengagement. During each phase of removal away from the hopper 1 of the bar 26, in fact, the shaft 39 penetrates into the cavity 33 causing the release of any faulty cigarette 2 therein from the cylindrical element 32 and acting, in respect of the said cigarette 2, as means for the interception of the end thereof.

From the foregoing explanation it is apparent that the final phase in the expulsion of faulty cigarettes 2 from the hopper 1 takes place in a controlled manner under the action of the said means of engagement and restraint, and at a speed such as to exclude the creation of the previously mentioned vortices and the discharge from the hopper 1 of cigarettes 2 adjacent to those expelled.

What is claimed is:

1. Device for infeeding cigarettes to the wrapping line of a packer, comprising a hopper for supplying the cigarettes, the lower part of said hopper being subdivided into a plurality of outgoing channels of a dimension virtually identical to the diameter of one cigarette, through which the cigarettes, placed in stacks, descend in steps; sensor means provided along each of said channels for checking the cigarettes in succession; at least one ejector device for each channel interconnected to a respective said sensor means for the expulsion from said channel of faulty cigarettes; and a contrivance for the interception and rejection of said faulty cigarettes, placed on the opposite side of said hopper from at least one ejector device provided with means for engaging with and restraining said faulty cigarettes during the expulsion thereof from each said channel, and movable parallel to the axis of said cigarettes between two extreme positions, one spaced away from said hopper at a distance less than the length of said cigarettes, and the other, at a distance greater.

2. Device according to claim 1, wherein said means of engagement and restraint are constituted by pointed elements that operate along the line of action of said at least one ejector device.

3. Device according to flaim 1, wherein said means of engagement and restraint are pneumatic.

4. Device according to claim 3, wherein said means of engagement and restraint comprise cylindrical elements movable along the line of action of said at least one ejector device and provided, at one extremity, with a virtually cylindrical cavity for receiving said faulty cigarettes connected to a source of suction.

5. Device according to claim 1, wherein said interception and rejection contrivance comprises means for disengaging said faulty cigarettes from said means of engagement and restraint.

6. Device according to claim 5, wherein said disengagement means are constituted by means for intercepting the ends of said faulty cigarettes during the transfer of said engagement and restraint means from said first to said second position.

7. Device according to claim 1, wherein said engagement and restraint means for all of said channels are supported by one common sustaining element given reciprocating motion by actuating means.

* * * * *